United States Patent [19]

Face, Jr.

[11] 4,097,926

[45] Jun. 27, 1978

[54] MIXER PADDLE SHAFT ASSEMBLY

[76] Inventor: Samuel A. Face, Jr., 1008 Magnalia Ave., Norfolk, Va. 23508

[21] Appl. No.: 770,530

[22] Filed: Feb. 22, 1977

[51] Int. Cl.[2] ..... B28C 5/14; B28C 7/16

[52] U.S. Cl. ..... 366/46; 366/47; 366/64; 366/185

[58] Field of Search ..... 259/178 R, 171, 45, 259/46, 25, 26, 109, 110, 161; 308/187; 74/606; 222/166

[56] References Cited

U.S. PATENT DOCUMENTS

| | | | |
|---|---|---|---|
| 2,723,110 | 11/1955 | Collins | 259/110 |
| 3,251,579 | 5/1966 | Lasar | 259/110 |
| 3,319,941 | 5/1967 | Isaacs | 259/161 |
| 3,334,871 | 8/1967 | Stone | 259/171 |
| 3,450,392 | 6/1969 | Vincent | 259/178 R |
| 4,043,540 | 8/1977 | Stone | 366/222 |

*Primary Examiner*—Robert W. Jenkins
*Attorney, Agent, or Firm*—Clarence A. O'Brien; Harvey B. Jacobson

[57] ABSTRACT

The invention provides a paddle shaft assembly for a mixing apparatus of the horizontal drum type wherein rotating mixing paddles contained within the horizontal drum can be removed for cleaning or replacement without disassembly of bearings, drive components or drum supporting structure. In particular, the drum is fully supported by mounting structure located externally of the drum, a quill shaft being disengageable from a drive shaft at one external end of the drum and removable from the drum through an opening at the other end of the drum to enable removal of the paddle shaft assembly without altering the drum structure in any way whatsoever.

9 Claims, 2 Drawing Figures

MIXER PADDLE SHAFT ASSEMBLY

BACKGROUND AND SUMMARY OF THE INVENTION

Mixing apparatus of the type to which the present invention most closely relates usually consists of a horizontal cylindrical mixing drum having an opening in its cylindrical wall which is normally at the top thereof and which serves as a material charge and discharge port. The horizontal drum of such apparatus is typically supported on a frame and is usually mounted to rotate through a predetermined arc in order to discharge mixed materials. The horizontal drum contains rotating mixing blades or paddles which are mounted or formed integrally with a rotary shaft, the rotary shaft being horizontally disposed within the drum and being typically aligned with the longitudinal axis of the horizontal drum. While apparatus of this type must be regularly cleaned regardless of the nature of the materials being mixed, it is especially necessary to frequently clean and replace mixing paddles when abrasive materials are being mixed. When abrasive materials are mixed with fast "setting" polymeric or similar materials, the maintenance problem is even more pronounced. It is to be appreciated that, in many use environments, cleaning of the mixing paddles must be frequently undertaken in order to prevent fouling of the entire apparatus. The mixing paddles must be quickly and easily removable by the mechanically unskilled workers charged with operation of the apparatus. This removal function must be carried out on the work site and with a minimum of ancillary equipment, such as special tools and the like. Prior U.S. Pat. Nos: 3,334,871, 3,905,519, 3,931,748 and 3,932,006 disclose mixing apparatus structures known in the prior art. Additionally, the following U.S. Patents disclose developments in this field of endeavor: U.S. Pat. Nos. 900,227—Oct. 6, 1908 U.S. Pat. Nos. 1,625,762—Apr. 19, 1922 U.S. Pat. Nos. 1,801,685—Apr. 21, 1931 U.S. Pat. Nos. 2,498,363—Feb. 21, 1950 U.S. Pat. Nos. 2,576,575—Nov. 27, 1951 U.S. Pat. Nos. 2,723,110—Nov. 8, 1955 U.S. Pat. Nos. 3,232,210—Feb. 1, 1966 U.S. Pat. Nos. 3,319,941—May 16, 1967.

Prior mixing apparatus of the type referred to hereinabove are not susceptible to facile removal of the mixing paddles therefrom for periodic cleaning and replacement. Removal of that portion of the shaft on which the mixing paddles are mounted in prior mixing apparatus usually requires access to the interior of the drum. Other prior apparatuses require removal of the entire shaft along with disassembly of bearings and other associated mounting structure. Apparatus of both types often are structured in such a way that the drive shaft supports the entire weight of the mixing drum. In such cases, complete disassembly of the mixing apparatus is necessary in order to remove the mixing paddles for routine cleaning and maintenance. Besides the requirement for substantial time and mechanical skill for such disassembly, expense is multiplied by the further requirement for complicated alignment and other manual operations for reassembly of the apparatus. The use of these prior art structures, particularly in the mixing of materials which set up within a short period of time, thereby requiring frequent cleaning, introduces expense inefficiencies and on the typical work site due to lack of mechanically qualified personnel.

The present invention finds solution to the problem outlined hereinabove by provision of a quill shaft engageable at its inner end with a drive shaft and mounting a hollow shaft thereon along a major portion of its length, the hollow shaft having mixing paddles mounted thereon or integrally formed therewith. The outer end of the quill shaft extends through the free end of the mixing drum and is removable by unbolting a flange on the end of the quill shaft from externally of the drum. The quill shaft can be drawn from the drum through a tubular support sleeve, withdrawal of the quill shaft from the drum disconnecting the hollow shaft and mixing paddle assembly from any mounting contact with the drum or drive shaft. The hollow shaft and mixing paddle assembly can then be conveniently removed from the charge and discharge port formed in the mixing drum. The bearings supporting the drive shaft and support sleeve are all disposed externally of the mixing drum and are fixed to the exterior end portion of the drum. Neither the bearings nor any portion of the mixing apparatus which supports the mixing drum need be disassembled in order to remove the mixing paddles from the mixing drum. The prime mover and other drive structure constituting the power train for driving the drive shaft remains intact on removal of the mixing paddles. The present structure, therefore, allows rapid and facile removal of the mixing paddles from the mixing drum by relatively untrained personnel using only the simplest of tools.

Accordingly, it is an object of the invention to provide a mixing apparatus comprised of a cylindrical mixing drum and having mixing paddles mounted for rotation therein, which mixing paddles can be rapidly and readily disconnected from a supporting rotary shaft without access to the interior of the drum.

It is a further object of the invention to provide a quill shaft removable from a mixing apparatus of the cylindrical drum type wherein mixing paddles are mounted on said shaft within the drum for rotary motion, the mixing paddles being disconnected from the shaft on removal of the shaft from the drum and the shaft being removable from the drum without access to the interior of the drum.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1, 2:
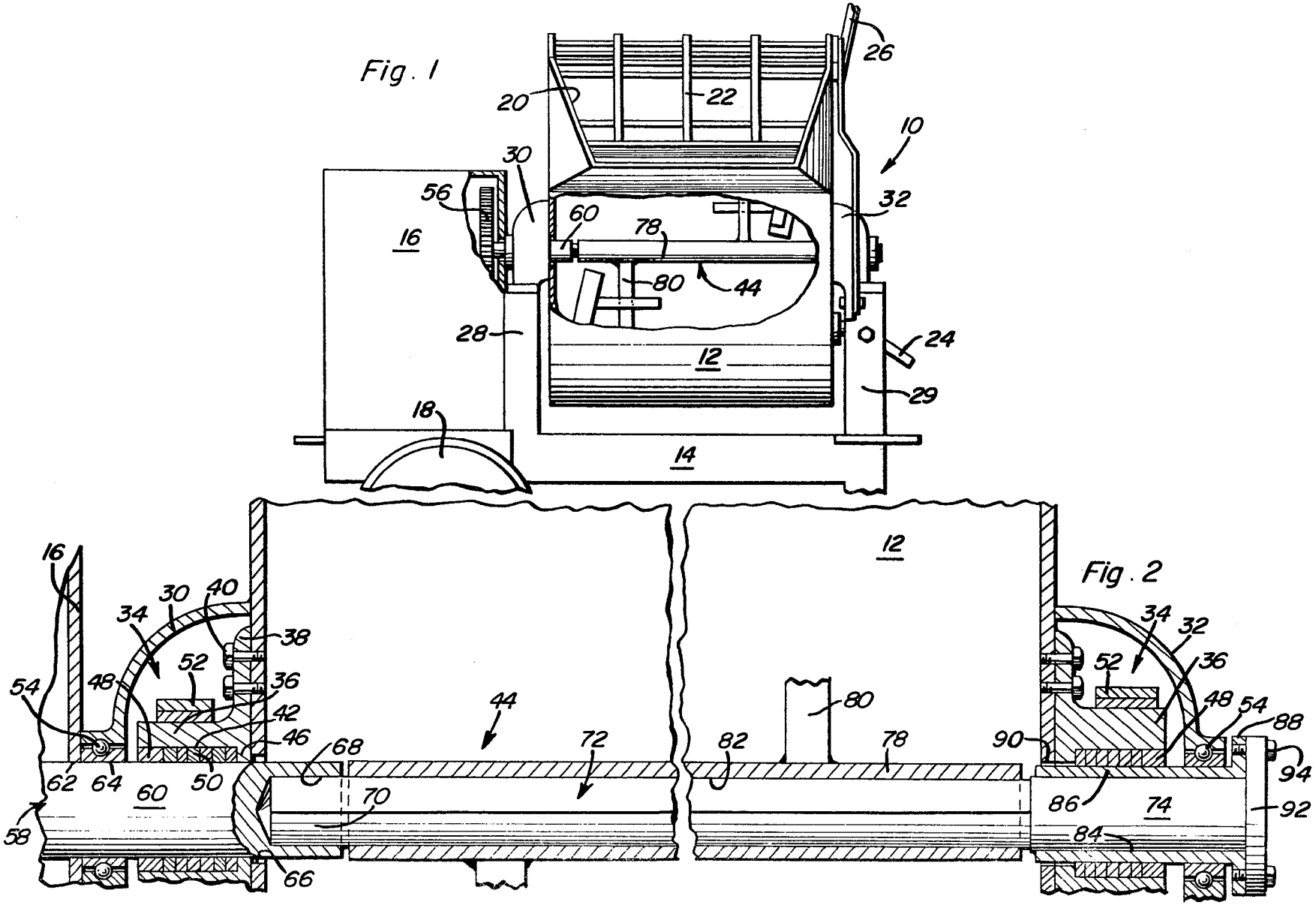
FIG. 1 is an elevational view partially cut away illustrating the apparatus of the invention.
FIG. 2 is an elevational view in section of a portion of the apparatus illustrating the structure of the present shaft assembly.

Referring to FIG. 1 of the drawings, a mixing apparatus is seen at 10 which includes the present shaft assembly. The apparatus 10 is seen generally to comprise a horizontal cylindrical mixing drum 12 mounted on a frame 14, the frame 14 further mounted on a first end thereof a cowl housing 16 containing a motive power and drive system (not fully shown). The frame 14 can be stationary or mounted for mobile transport on wheels 18. The structure thus described is well known in the art and need not be described in detail. The drum 12 has a material charge and discharge port 20 formed in an upper surface thereof, the port 20 being surmounted by a pivotable guard 22. The drum 12 can be pivoted through an arc through release of a locking latch 24 and manual movement of the drum by means of a tilt handle 26 in a known fashion.

The drum 12 is supported at either end thereof by pedestals 28 and 29 which constitute vertical extensions of the frame 14. Shell housings 30 and 32 are connected to either end of the drum 12 and to respective upper end portions of the pedestals 28 and 29, the shell housings 30 and 32 being either mechanically connected to or formed integrally with the drum 12 and pedestals 28 and 29. The shell housings 30 and 32 each enclose seal and bearing assemblies 34, which assemblies are substantially identical in structure and operation. Description of one of the bearing assemblies will, therefore, suffice for description of the other with the details of the bearing and seal assemblies 34 being disclosed in U.S. Pat. No. 3,932,006. Each assembly 34 comprises a bearing collar 36 having an annular flange 38 on its inner end. The flange 38 is secured to the end of the mixing drum 12 by means of bolts 40 or similar connectors. The collar 36 has a central aperture 42 for receiving at least a portion of a rotary shaft assembly 44 therethrough, the collar 36 further having an annular shoulder 46 formed about the periphery of the aperture 42 at the convex end of the collar. The annular shoulder 46 extends toward the shaft assembly 44 and in combination with an annular retaining and bearing member 48 disposed about the periphery of the aperture 42 at the outer end of the collar 36, retains packing assembly 50 along the shaft assembly 44 to provide a sealing and bearing function. A bearing block 52 is further disposed about the collar 36 and supports the collar from the pedestal as disclosed in the aforementioned patent. Further bearing function is provided by means of ball bearings 54 mounted in the shell housings 30 and 32 at opposite ends of the shaft assembly 44.

The shaft assembly 44 is driven by motive power apparatus (not shown) disposed within the cowl housing 16, the power apparatus driving a gear 56 which is mounted on a drive shaft 58. The drive shaft 58 essentially comprises a solid cylindrical shaft 60 which extends through apertures 62 and 64 in the cowl housing 16 and shell housing 30, respectively. The drive shaft 58 is received within the aperture 42 of the bearing collar 36 and is mounted for rotation thereby and by the ball bearing 54. The drive shaft 58 further extends a short distance into the interior of the drum 12 through an aperture 66, the apertures 42, 62, 64, and 66 being aligned to receive the drive shaft 58. The drive shaft 58 has a square indentation or socket 68 formed centrally in the distal end thereof, which indentation 68 receives an inner end 70 of a quill shaft 72 thereinto, the quill shaft 72 being square in cross section at its inner end and along most of its length. The quill shaft has an outer end 74 which is cylindrical, i.e., is circular in cross section.

A hollow shaft 78 has mixing paddles 80 either mounted on the external surface thereof or formed integrally therewith, the paddles 80 being of conventional design. The shaft 78 can be either cylindrical or square in cross section. The shaft 78 is tubular and formed with a channel 82 extending longitudinally and along the full length of said shaft 78, the channel 82 being square in cross section and receiving the quill shaft 72 therethrough. The hollow shaft 78 and the mixing paddles 80 thus rotate on rotation of the quill shaft 72. The dimensions of the quill shaft and the channel 82 are so proportioned as to enable the shaft 78 to be slidable onto the quill shaft 72 and to provide essentially a friction fit therebetween.

The cylindrical outer end 74 of the quill shaft 72 is received within an aperture 84 in a rotary sleeve 86, the sleeve 86 having an annular flange 88 formed on its outer end. The sleeve 86 extends minimally into the interior of the drum 12 through an aperture 90 formed in the end of the drum 12 opposite the end thereof through which the drive shaft 58 extends, the aperture 90 being aligned with the aperture 66 formed in said opposite end of the drum. The sleeve 86 is mounted for rotary non-linear movement by means of the other of the sealing and bearing assemblies 34 and the other of the ball bearings 54. The cylindrical outer end 74 of the quill shaft 72 is slidable within the sleeve 86 and rotatable therewith. A flange or plate 92 integral or rigid with the quill shaft 72 is connected to the flange 88 of the sleeve 86 such as by stud bolts 94 or similar connectors, the plate 92 being rotatable with the shaft assembly 44.

The plate 92 can be released from connection to the flanged sleeve 86 by simple removal of the bolts 94. The quill shaft 72 can then be pulled through the sleeve 86. On withdrawal of the quill shaft 72 through the sleeve 86, the shaft 72 is withdrawn from the square indentation 68 in the drive shaft 58 and thereby disengages from said drive shaft. The quill shaft 72 is subsequently drawn through the hollow shaft 78, thus disconnecting the shaft 78 and attached paddles 80 from mounting engagement with any portion of the structure of the mixing apparatus 10. The quill shaft 72 is finally fully withdrawn from the interior of the drum 12 through the sleeve 86, removal of the shaft 72 from said drum being fully accomplished without access to the interior of the drum. The shaft 78 and attached paddles 80 can then be conveniently removed from the interior of the drum 12 through the charge and discharge port 20 for cleaning or replacement thereof. The aforesaid operations can be accomplished quickly by mechanically unskilled personnel using only the most simple and basic of tools.

Reassembly of the shaft assembly 44 is readily accomplished by reversal of the procedure described above. Disassembly and reassembly of the shaft assembly 44 as aforesaid is accomplished without disassembly of structure supporting the drum 12. Therefore, the present structure allows more rapid and facile removal of the mixing paddles 80 from the interior of the drum 12 for on site cleaning and replacement thereof. Suitable lubrication fittings for the seals and bearings are provided where necessary and thrust type bearings are utilized to maintain the rotatable components in axial position.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. Apparatus for mixing materials together comprising, in combination:

frame means;

drum means mounted on said frame means for receiving said materials for mixing thereof;

motive means mounted on said frame means;

a drive shaft driven by said motive means, the free end of the drive shaft extending into the interior of the drum means, the drive shaft having an indentation formed in said free end;

a quill shaft disposed at least partially within the interior of the drum means, a first end of the quill shaft being slidably received within the indentation in the drive shaft, the quill shaft being thereby rotatable on rotation of the drive shaft, a second end of the quill shaft extending through an end of the drum means externally thereof;

a hollow shaft having a longitudinal channel extending therethrough, the quill shaft being slidably received within the channel, the hollow shaft being rotatable on rotation of the quill shaft;

mixing paddle means joined to the hollow shaft and extending therefrom to mix materials within said drum means;

first bearing means for mounting the drive shaft for rotation relative to the drum means;

second bearing means for mounting the second end of the quill shaft for rotation relation to the drum means; and retaining means external of the drum means for maintaining the quill shaft in connecting relation to the drive shaft, the retaining means being releaseable to allow the quill shaft to be withdrawn from the interior of the drum means.

2. The apparatus of claim 1 wherein said first and second bearing means are mounted respectively to opposite ends of the drum means externally of said drum means.

3. The apparatus of claim 2 and further comprising a sleeve having an annular flange on its outer end, the sleeve having a channel longitudinally formed therein, the second end of the quill shaft being slidably received within the channel in the sleeve, the inner end of the sleeve extending into the interior of the drum means.

4. The apparatus of claim 3 wherein the retaining means comprise a flange on the quill shaft removably connected to the annular flange of the sleeve, and connecting means for joining the quill shaft flange to said sleeve flange, removal of the connecting means allowing removal of the quill shaft from the interior of the drum means through said channel in said sleeve.

5. The apparatus of claim 3 wherein the quill shaft is square in cross section at its first end and along the major portion of its length, the indentation in the drive shaft being square in cross section to slidably receive said first end of said quill shaft, the channel in the hollow shaft being square in cross section to slidably receive portions of the quill shaft therethrough, the second end of the quill shaft being circular in cross section, the channel in the sleeve being circular in cross section to slidably receive said second end of said quill shaft therethrough, the longitudinal axes of the drive shaft, the indentation in said drive shaft, the quill shaft, the hollow shaft, the channel in said hollow shaft, the sleeve, and the channel in said sleeve being coincidental.

6. The apparatus of claim 2 wherein the first and second bearing means each comprise a cylindrical bearing collar having a channel formed longitudinally therethrough and an annular flange formed on the inner end of the collar about the periphery of the channel, the flange being fixedly mounted to exterior end surfaces of the drum means, the drive shaft extending through said channel in the bearing collar of the first bearing means and the second end of the quill shaft extending through the channel in the bearing collar of the second bearing means.

7. In a mixer having a drum provided with opposed walls, a paddle shaft extending between the opposed walls of the drum and including paddles thereon, the opposed walls of the drum having external bearing assemblies forming the rotational axis of the paddle shaft, said drum being horizontally disposed and pivotally supported for movement about an axis coincident with the rotational axis of the paddle shaft, said bearing assemblies journaling the paddle shaft also supporting said drum for pivotal movement, said paddle shaft being hollow, means extending exteriorly of the drum for driving the paddle shaft, that improvement comprising shaft means connected with the paddle shaft and extending longitudinally from each end thereof, said shaft means being journaled in the bearing assemblies on the opposed walls of the drum and at least one end thereon being accessible exteriorly of the bearing assemblies, means separably, drivingly connecting at least one end of the shaft means to said drive means outwardly of the paddle shaft, and means detachably connecting the shaft means with the paddle shaft to enable separation of the shaft means from the paddle shaft, said bearing assemblies enabling insertion and removal of the shaft means longitudinally in relation to the drive means, paddle shaft and bearing assemblies, said shaft means including an elongated quill shaft extending through said paddle shaft and being drivingly and removably connected thereto, thereby enabling longitudinal removal of the quill shaft from the paddle shaft thereby enabling the paddle shaft and paddles to be removed from the drum without removing the drum or the drive means.

8. The structure as defined in claim 7 wherein said quill shaft has one end extending through and supported by one of said bearing assemblies, the other end of said quill shaft being supported by said drive means with the separable driving connecting means enabling the quill shaft to be moved longitudinally during removal and insertion thereby enabling the driving connection to be established or separated in response to longitudinal movement of the quill shaft.

9. In a mixer having a drum provided with opposed walls, a paddle shaft extending between the opposed walls and being carried and defining a rotational axis therebetween, the paddle shaft being hollow, the improvement further comprising:

shaft means connected with the paddle shaft and extending longitudinally from each end thereof for mounting the paddle shaft for rotation, the shaft means including a quill shaft extending through the paddle shaft and being drivingly connected thereto;

means mounted on the mixer for driving the shaft means; and, means for detachably connecting the quill shaft with the paddle shaft to enable separation of the shaft means from the paddle shaft, the quill shaft being removable from the paddle shaft to enable the paddle shaft to be removed from the drum without disassembly of the drum and driving means.

* * * * *